US010993561B2

(12) United States Patent
Wiesman et al.

(10) Patent No.: US 10,993,561 B2
(45) Date of Patent: May 4, 2021

(54) DISPENSING FLUIDS FROM DRINKING CONTAINERS

(71) Applicant: Momma Goose, Inc., Weston, MA (US)

(72) Inventors: Joshua Wiesman, Weston, MA (US); Keith Tritschler, Greystones County (IE); David Tesini, Hopkinton, MA (US); Brian Thornfeldt, Wayland, MA (US)

(73) Assignee: JAMISON CREEK HOLDINGS, LLC, Ashland, OH (US)

( * ) Notice: Subject to any disclaimer, the term of this patent is extended or adjusted under 35 U.S.C. 154(b) by 0 days.

(21) Appl. No.: 15/933,693

(22) Filed: Mar. 23, 2018

(65) Prior Publication Data

US 2019/0290037 A1 Sep. 26, 2019

(51) Int. Cl.

| | |
|---|---|
| ***A47G 19/22*** | (2006.01) |
| ***A47G 21/18*** | (2006.01) |
| ***B65D 47/06*** | (2006.01) |
| ***B65D 47/20*** | (2006.01) |

(52) U.S. Cl.

CPC ..... *A47G 19/2272* (2013.01); *A47G 21/186* (2013.01); *B65D 47/066* (2013.01); *B65D 47/2031* (2013.01); *B65D 2543/00046* (2013.01); *B65D 2547/06* (2013.01)

(58) Field of Classification Search

CPC ..... A47G 19/2272; A47G 19/2266; A47G 21/186; A47G 21/18; B65D 47/066; B65D 47/2031; B65D 47/065; B65D 2543/00046; B65D 2547/06

USPC ..... 220/714

See application file for complete search history.

(56) References Cited

U.S. PATENT DOCUMENTS

| | | | | |
|---|---|---|---|---|
| 3,181,743 | A * | 5/1965 | Libit | B65D 47/066 222/528 |
| 5,873,478 | A * | 2/1999 | Sullivan | A47G 19/2266 215/389 |
| 6,994,225 | B2 | 2/2006 | Hakim | |
| D547,606 | S | 7/2007 | Forsman | |
| D547,607 | S | 7/2007 | Forsman | |
| 7,533,783 | B2 | 5/2009 | Choi et al. | |
| D617,465 | S | 6/2010 | Hakim | |
| 8,191,727 | B2 | 6/2012 | Davies et al. | |
| 8,252,224 | B2 | 8/2012 | Blain | |
| 8,469,226 | B2 | 6/2013 | Davies et al. | |
| 8,622,237 | B2 | 1/2014 | Choi et al. | |

(Continued)

FOREIGN PATENT DOCUMENTS

| | | |
|---|---|---|
| AU | 2006235383 | 10/2006 |
| AU | 2011201183 | 4/2011 |

(Continued)

*Primary Examiner* — Andrew D Perreault

(74) *Attorney, Agent, or Firm* — Armstrong Teasdale LLP

(57) ABSTRACT

A fluid dispenser includes a lid that defines an opening and that includes a first sealing element. The fluid dispenser further includes a flexible fluid delivery component that defines an interior fluid channel. The flexible fluid delivery component includes a second sealing element configured to cooperate with the first sealing element of the lid to form a fluid-tight seal between the flexible fluid delivery component and the lid and a valve element configured to cooperate with the opening in the lid to regulate an airflow through the opening in the lid.

18 Claims, 10 Drawing Sheets

(56) References Cited

U.S. PATENT DOCUMENTS

| | | | | |
|---|---|---|---|---|
| D707,124 | S | 6/2014 | Blain et al. | |
| 8,777,048 | B2 | 7/2014 | Choi et al. | |
| D716,657 | S | 11/2014 | Caneer | |
| D719,444 | S | 12/2014 | Sullivan | |
| D719,445 | S | 12/2014 | Caneer | |
| D719,780 | S | 12/2014 | Sullivan | |
| D719,827 | S | 12/2014 | Duran et al. | |
| 8,905,252 | B2 | 12/2014 | Latham et al. | |
| D732,392 | S | 6/2015 | Duran et al. | |
| 9,113,698 | B2 | 8/2015 | Blain et al. | |
| 9,456,710 | B2 | 10/2016 | Blain et al. | |
| 9,463,911 | B2 | 10/2016 | Choi et al. | |
| D796,902 | S | 9/2017 | Gordon | |
| 9,782,028 | B2 | 10/2017 | Davies et al. | |
| 9,820,595 | B2 | 11/2017 | Davies et al. | |
| 2007/0021604 | A1 | 1/2007 | Deng et al. | |
| 2010/0181329 | A1* | 7/2010 | Davies | A47G 19/2266 220/707 |
| 2016/0150898 | A1* | 6/2016 | Hoskins | A47G 19/2266 215/311 |
| 2017/0208974 | A1* | 7/2017 | Zhang | A47G 19/2272 |

FOREIGN PATENT DOCUMENTS

| | | | |
|---|---|---|---|
| AU | 2012202351 | | 5/2012 |
| AU | 354206 | | 3/2014 |
| AU | 354207 | | 3/2014 |
| AU | 2014237241 | | 9/2014 |
| AU | 2014249322 | | 10/2014 |
| AU | 201616312 | | 12/2016 |
| AU | 201616313 | | 12/2016 |
| CA | 2643788 | | 3/2013 |
| CA | 2791377 | | 1/2015 |
| CA | 2904390 | | 4/2017 |
| CA | 2906058 | | 5/2017 |
| CA | 171462 | | 7/2017 |
| CA | 171463 | | 7/2017 |
| CN | 201430015820.9 | | 7/2014 |
| CN | 201430034190.X | | 7/2014 |
| CN | 201430035471.7 | | 7/2014 |
| CN | ZL 201430016018.1 | | 7/2014 |
| CN | 102670022 | B | 11/2014 |
| CN | 105209349 | A | 12/2015 |
| CN | 105246378 | B | 3/2017 |
| CN | ZL 201630559100.8 | | 4/2017 |
| CN | 201630558959.7 | | 6/2017 |
| EM | 000979802-0002 | | 7/2008 |
| EM | 000979802-0003 | | 7/2008 |
| EM | 000979802-0001 | | 8/2008 |
| EM | 002411009-0001 | | 2/2014 |
| EM | 002411009-0002 | | 2/2014 |
| EM | 002411009-0003 | | 2/2014 |
| EM | 002411009-0004 | | 2/2014 |
| EM | 003459734-0001 | | 11/2016 |
| EM | 003459759-0001 | | 11/2016 |
| EP | 1874646 | | 8/2016 |
| GB | 2439905 | | 9/2009 |
| GB | 2457608 | | 1/2010 |
| HK | 1126636 | | 3/2013 |
| HK | 1176254 | | 6/2015 |
| TW | I297317 | | 2/2007 |

* cited by examiner

DISPENSING FLUIDS FROM DRINKING CONTAINERS

TECHNICAL FIELD

This disclosure relates to fluid dispensers, and more particularly to fluid dispensers that can dispense fluid from a drinking container on demand.

BACKGROUND

Drinking containers (e.g., baby bottles and "sippy cups") can be used to dispense fluid to young children on demand, such as when a child applies suction to a fluid dispenser of a drinking container. Such drinking containers can contain enough fluid content for a typical feeding of a young child. When a child applies suction to the fluid dispenser, the child occasionally needs to pause the suctioning action to allow air into the drinking container to equalize a pressure in the drinking container, which can cause frustration. Drinking containers used to dispense fluid to young children should be designed for easy use, handling, and cleaning.

SUMMARY

This disclosure generally relates to fluid dispensers, and more particularly to fluid dispensers that can dispense fluid from a drinking container to a young child on demand.

In one aspect, a fluid dispenser includes a lid that defines an opening and that includes a first sealing element. The fluid dispenser further includes a flexible fluid delivery component that defines an interior fluid channel. The flexible fluid delivery component includes a second sealing element configured to cooperate with the first sealing element of the lid to form a fluid-tight seal between the flexible fluid delivery component and the lid and a valve element configured to cooperate with the opening in the lid to regulate an airflow through the opening in the lid.

Embodiments may include one or more of the following features.

In some embodiments, the lid is a rigid component that is configured to be secured to a container.

In certain embodiments, the lid is configured to support the flexible fluid delivery component.

In some embodiments, the first sealing element includes a protruding edge.

In certain embodiments, the second sealing element includes one or more flanges that are configured to form a compression fit with the protruding edge.

In some embodiments, the opening in the lid is a first opening, and the lid further defines a second opening that is sized to allow passage of the flexible fluid delivery component.

In certain embodiments, the valve element of the flexible fluid delivery component is configured to contact the lid to close the opening in the lid to prevent air from flowing through the opening.

In some embodiments, the valve element of the flexible fluid delivery component is configured to separate from the lid to permit air to flow through the opening in the lid.

In certain embodiments, the valve element of the flexible fluid delivery component is configured to be forced away from the lid while the first and second sealing elements are engaged to form the fluid-tight seal.

In some embodiments, the valve element of the flexible fluid delivery component is configured to deform in response to a change in a pressure of fluid in contact with the flexible fluid delivery component.

In certain embodiments, the flexible fluid delivery component is foldable upon itself to a compressed configuration.

In some embodiments, the lid defines a protrusion configured to retain the flexible fluid delivery component within a cavity of the lid in the compressed configuration.

In certain embodiments, the flexible fluid delivery component includes an elongate mouthpiece that defines a portion of the interior fluid channel.

In some embodiments, the elongate mouthpiece includes a curved end surface that closes the interior fluid channel.

In certain embodiments, the curved end surface defines a slit through which fluid can flow out of the interior fluid channel of the flexible fluid delivery component.

In some embodiments, the flexible fluid delivery component includes multiple elongate support elements disposed about the interior fluid channel.

In certain embodiments, the fluid dispenser further includes a container to which the lid can be secured for containing a fluid within the container.

In some embodiments, the lid and the container include threaded portions by which the lid and the container can be secured to each other.

In certain embodiments, the flexible fluid dispenser is configured to dispense a liquid or a slurry.

In some embodiments, the fluid dispenser further includes a straw sized to fit within the flexible fluid delivery component.

Embodiments may provide one or more of the following advantages.

In some embodiments, a spout includes a flange that is seated against a ridge of the lid such that the flange and the ridge together form a pressure relief valve (e.g., an atmospheric vent) adjacent a small opening in the ridge. For example, when a mouthpiece of the spout is not in use (e.g., free from a suction force), the flange contacts the ridge and therefore closes the small opening in the ridge. However, as fluid is suctioned out of the container through the mouthpiece (e.g., thereby reducing the pressure inside of the container), the flange is forced downward (e.g., pulled inward) by negative pressure generated within the container by the suction force. For example, the negative pressure within the container is equalized by the atmospheric pressure external to the fluid dispenser, thereby forcing air past an interface between the ridge and the flange. In this manner, the spout acts as pressure relief valve that can modulate (e.g., equalize) the pressure within the container without the child having to pause a suctioning action to equalize the pressure within the container.

In some embodiments, a relatively large proximal region of the mouthpiece can comfortably fit within the mouth of a child, which is wider than an area formed by the lips of the mouth when the lips are pursed about a smaller, central region of the mouthpiece.

In some embodiments, the mouthpiece defines multiple ribs disposed along each side of a fluid channel. An arrangement of the ribs along an inner surface of the fluid channel generally follows a curvature of the roof of the mouth such that the mouthpiece can be comfortably disposed in the child's mouth. Furthermore, the ribs maintain a structural integrity of the spout, while still allowing the spout to be flexibly deformed (e.g., compressed) by the lips or teeth during suctioning. In some embodiments, the spout also defines multiple ribs that extend from a base to the mouthpiece along the fluid channel. Such ribs maintain a structural integrity of a distal region of the mouthpiece, while still allowing the spout to be flexibly folded upon itself in the compressed configuration.

In some embodiments, an end of the mouthpiece is formed as a recessed cavity. A bottom wall of the recessed cavity closes the fluid channel, which itself has a cross-sectional shape that is generally round-rectangular. The bottom wall has a generally oval or elliptical cross-sectional shape in one plane and has a generally dome-shaped cross-sectional profile in a second, orthogonal plane. A slit is disposed along a centerline of the bottom wall in a vertical or horizontal orientation. Fluid can be withdrawn from the container through the slit when a suction force is applied to the mouthpiece, and a small amount of withdrawn fluid can pool in the recessed cavity. Owing to the dome shape of the bottom wall, when the proximal region of the mouthpiece is compressed, the bottom wall bows outward to open the mouthpiece along the slit to allow fluid to flow through the slit. Such configuration advantageously allows the mouthpiece to open to a wider extent than can other conventional mouthpieces with flat end surfaces that do not bow outward to such an extent when compressed. While the fluid dispenser is at rest (e.g., while no suction is applied), the slit in the bottom wall also provides a fluid-tight seal. Additionally, the rounded dome shape of the bottom wall is more durable than what would otherwise be a similar bottom wall that has a flat surface. For example, the dome-shaped bottom wall, when at rest, directs force against the bottom wall toward a top central region of the bottom wall, such that the slit is effectively forced shut and such that pressure is distributed against the bottom wall (e.g., in a manner that mechanics are similarly effected by an archway structure in a bridge or domed building).

Other aspects, features, and advantages will be apparent from the description, the drawings, and the claims.

DETAILED DESCRIPTION

Figure 1:
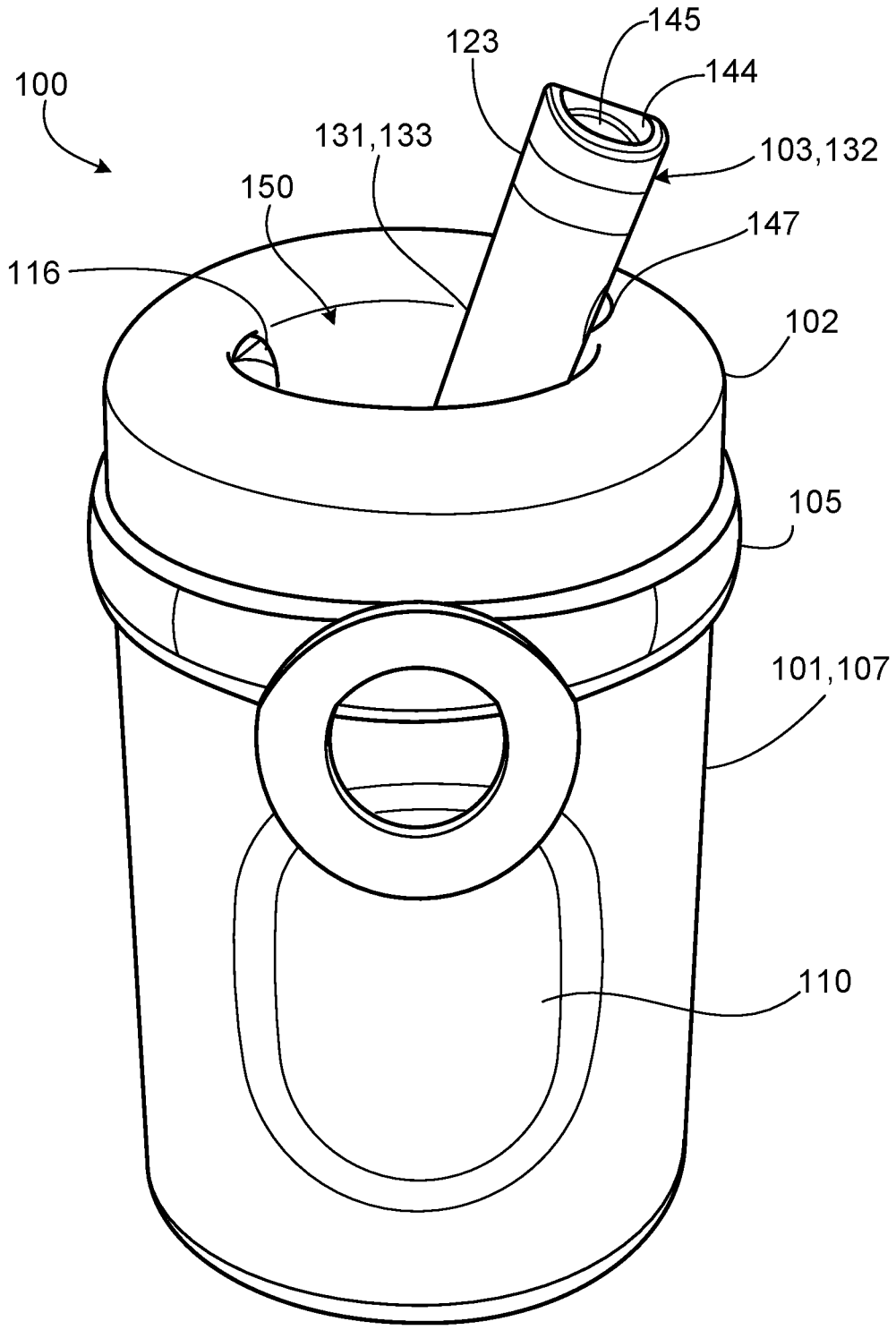
FIG. 1 is a perspective view of a fluid dispenser with a spout in an extended configuration.
Figure 2:
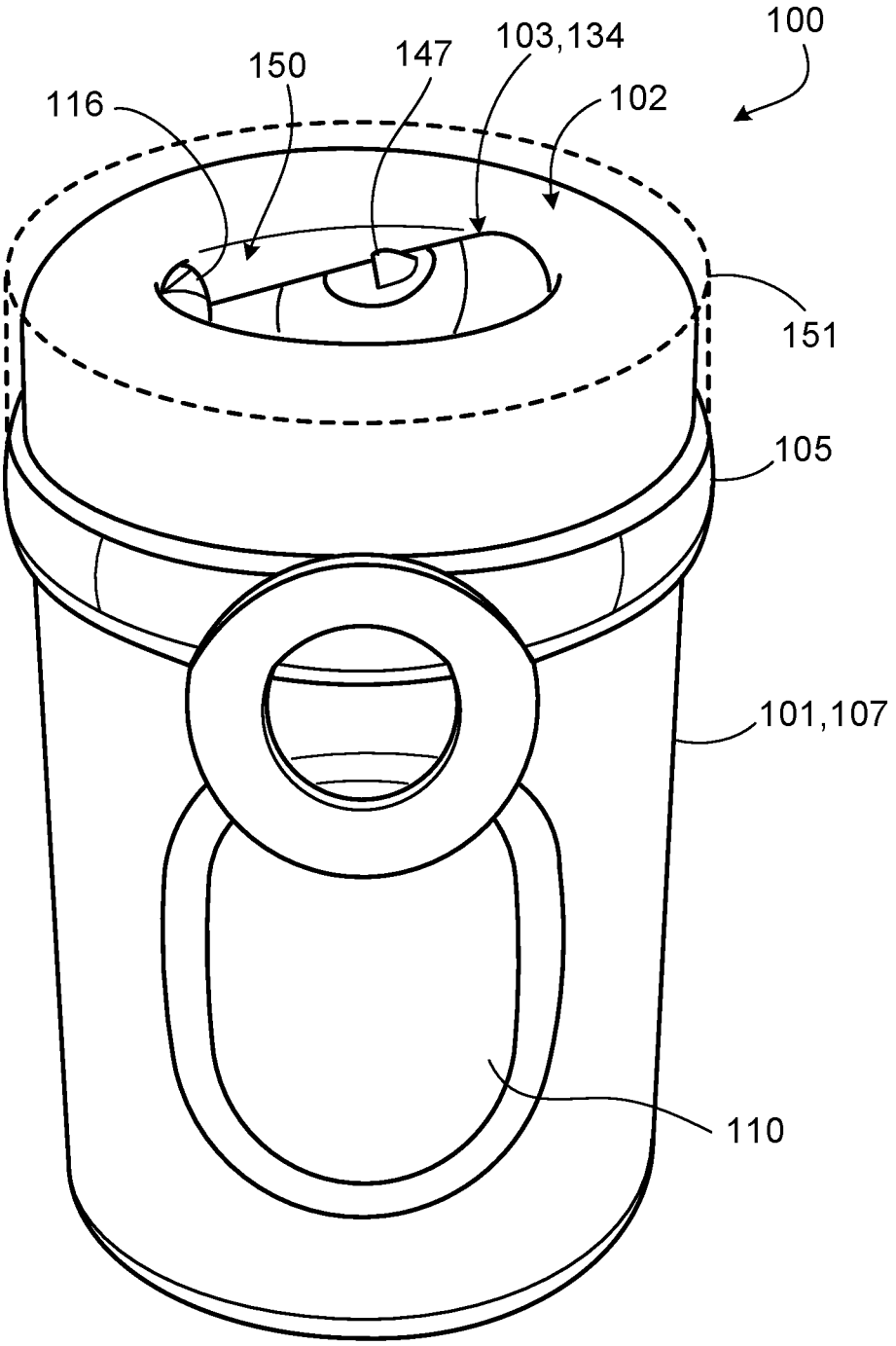
FIG. 2 is a perspective view of the fluid dispenser of FIG. 1 with the spout in a compressed configuration and with a cap covering a lid of the fluid dispenser.

FIGS. 1 and 2 illustrate a fluid dispenser 100 (e.g., a drinking dispenser) designed to dispense fluids (e.g., liquids and slurries) to young children (e.g., infants and toddlers) on demand. The fluid dispenser 100 is a multiple-use device that can be assembled, used, disassembled, cleaned, reassembled, and reused. The fluid dispenser 100 is typically filled with one or more fluids, such as water, milk or breastmilk, juice, liquid-solid food slurries, or a mixture of a fluid and a therapeutic agent (e.g., an antibiotic or a dietary supplement). Accordingly, the fluid dispenser 100 can serve as a baby bottle or a sippy cup. The fluid dispenser 100 includes a container 101 that can be filled with a fluid, a lid 102 that covers an opening of the container 101, a spout 103 that dispenses fluid from the container 101 to a child, a straw 104 that extends from the spout 103 within the container 101, and a sheath 105 (shown in FIG. 1) that surrounds an outer interface between the lid 102 and the container 101.

The container 101 includes a threaded flange 106 to which the lid 102 can be secured and a body 107 that defines an interior region 108 that can be filled with fluid. The body 107 defines a shoulder 109 that supports the sheath 105, two lateral depressions 110 that facilitate grasping of the container 101, and a bottom depression 111 that causes the fluid to pool within a circumferential fluid channel 149 of the container 101 for suction of the fluid through the straw 104. The container 101 has a generally circular cross-sectional shape and is sized such that the container 101 can easily be held by one hand of an adult or both hands of a young child. The body 107 of the container 101 typically has a length of about 6 cm to about 12 cm and an outer diameter of about 6 cm to about 8 cm. The interior region 108 of the body 107 can typically hold a fluid volume of about 150 mL to about 300 mL. The container 101 is a rigid component that is typically made of one or more materials, such as polypropylene, polyethylene, polyamide, polycarbonate, copolyester, silicone, and other thermoplastic elastomers. The container 101 may be manufactured via one or more techniques, such as stretch blow molding, blow molding, injection molding, or compression molding, depending on a material formulation of the container 101. For example, in embodiments wherein the container 101 is made of a thermoplastic elastomer (TPE) or silicone, the container 101 may be manufactured via injection molding or compression molding.

Figure 3:
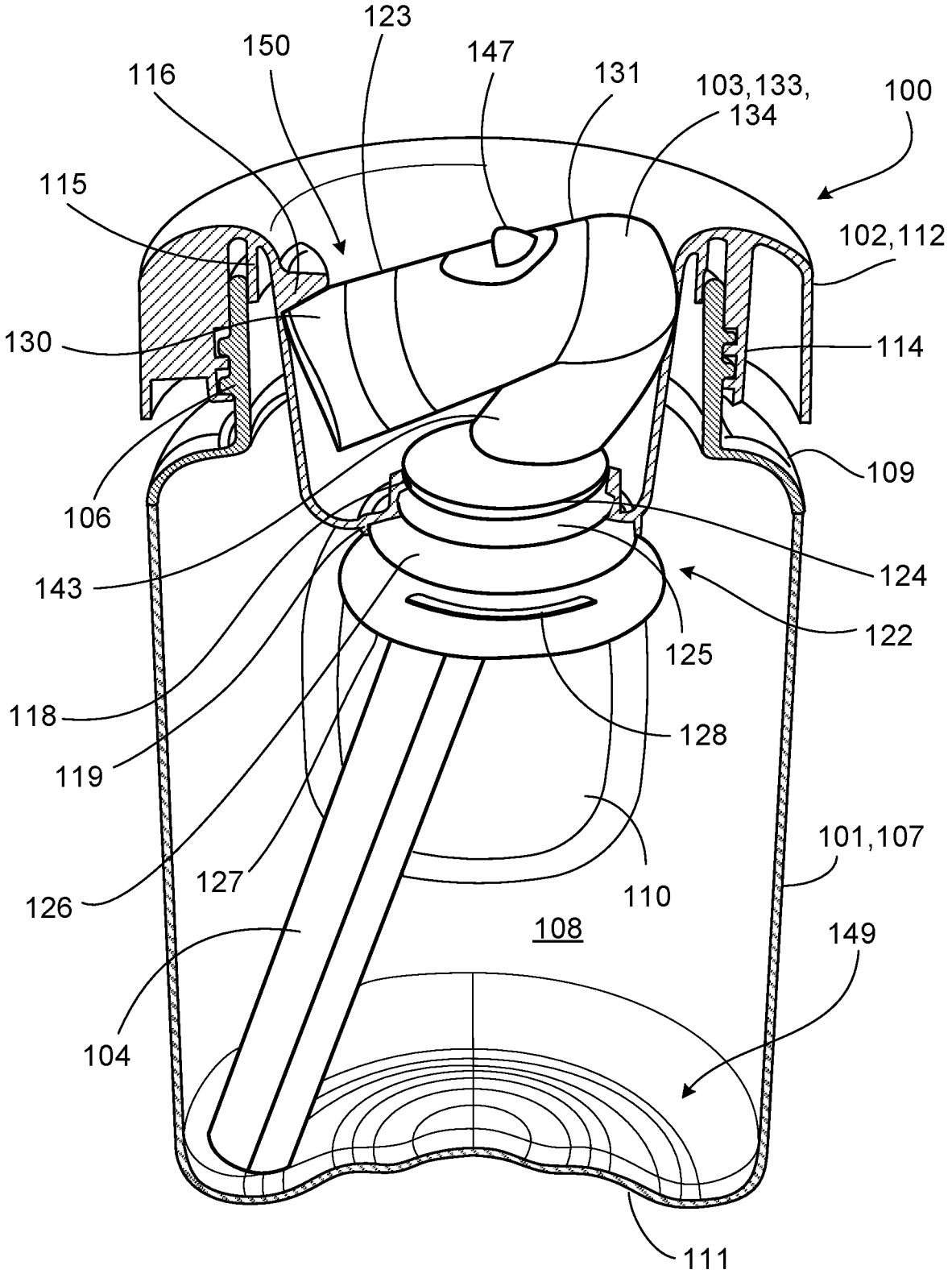
FIG. 3 is a cutaway perspective view of the fluid dispenser of FIG. 1 with the spout in the compressed configuration.

Referring to FIGS. 1-5, the lid 102 is formed to be secured to the container 101 and includes various profiles that facilitate manipulation of the lid 102 and that allow the lid 102 to interface with the container 101 and the spout 103. For example, the lid 102 defines an outer wall 112 by which the lid 102 can be grasped, an inner wall 113 defining a cavity 150 through which the spout 103 passes, a threaded wall 114 by which the lid 102 can be assembled with (e.g., threaded to) the threaded flange 106 of the container 101, an inner lip 115 that can further retain and seal against and the threaded flange 106, and a protrusion 116 that can maintain the spout 103 in a compressed configuration 134, as shown in FIGS. 2 and 3, and as will be discussed in more detail below. When fully engaged with each other (as shown in FIG. 3), the threaded wall 114 and the threaded flange 106 together form a fluid-tight seal between the lid 102 and the container 101. The inner lip 115 enhances this fluid-tight seal by increasingly compressing against the inside surface of threaded wall 106 as the threaded wall 114 and the threaded flange 106 are progressively engaged.

Figure 4:
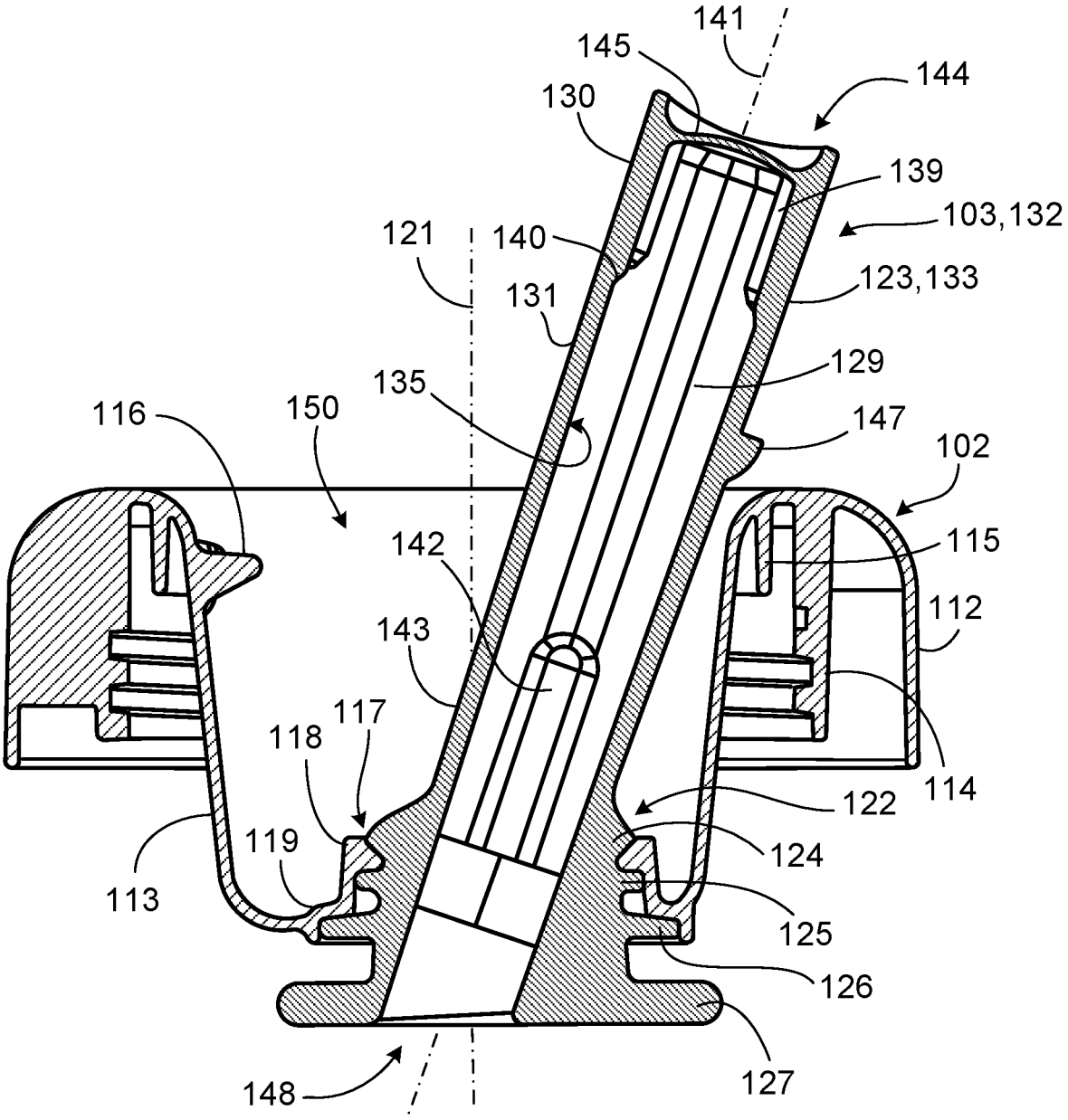
FIG. 4 is a cross-sectional view of the lid and the spout of the fluid dispenser of FIG. 1 in the extended configuration.
Figure 5:
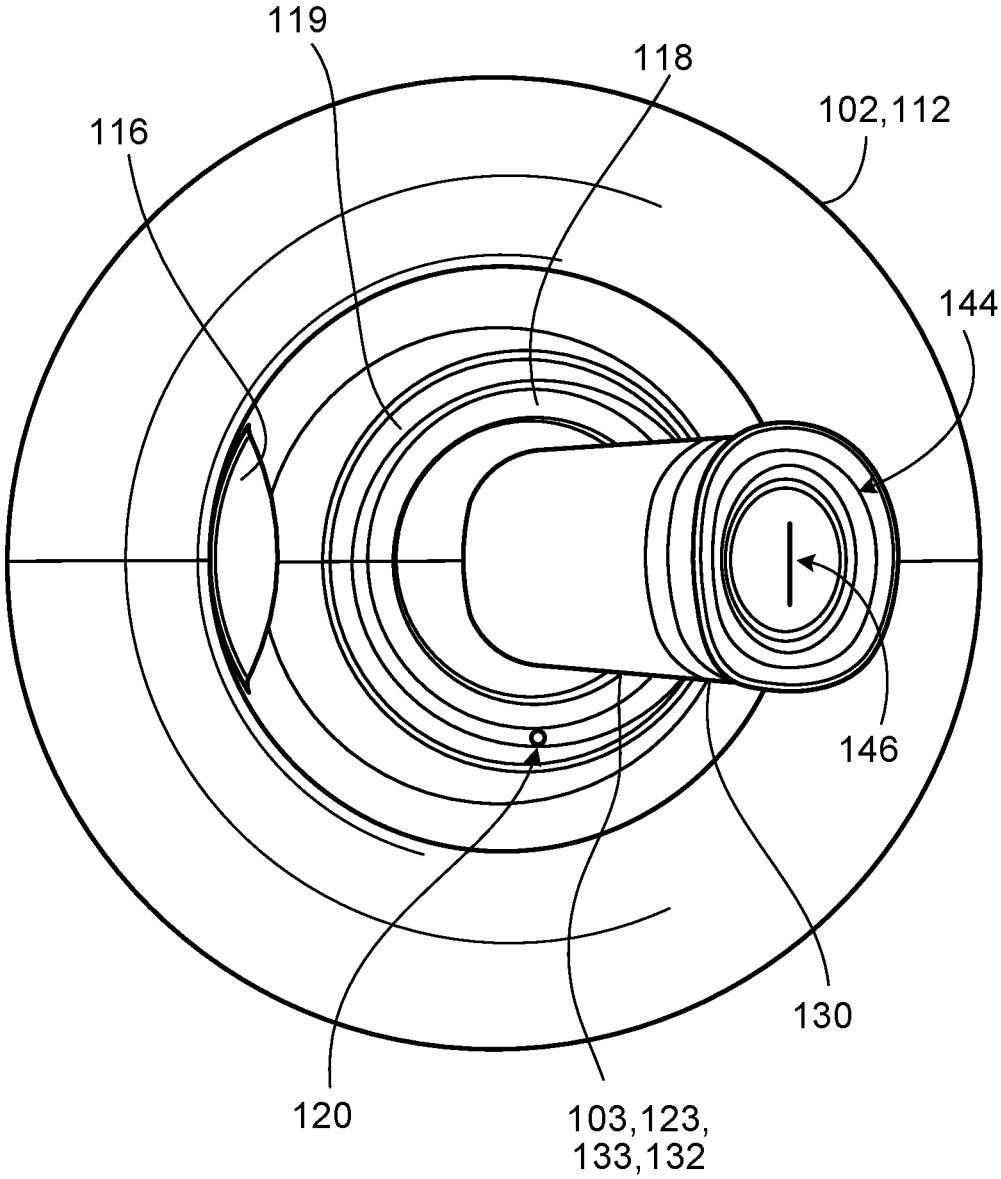
FIG. 5 is a top view of the lid and the spout of the fluid dispenser of FIG. 1 in the extended configuration.

Referring particularly to FIGS. 3-4, the inner wall 113 further defines an opening 117 through which the spout 103 passes and upper and lower ridges 118, 119 that are formed to engage the spout 103. Referring particularly to FIG. 5, the lid 102 defines a small opening 120 through the lower ridge 119 that allows ambient air to flow into the container 101, as will be discussed in more detail below. The inner wall 113 has a generally circular cross-sectional shape, and a center of the opening 117 is spaced apart from a central axis 121 of the lid 102. Accordingly, the lid 102 has an asymmetric profile that positions the spout 103 opposite the protrusion 116. The protrusion 116 is formed as a semi-spherical wedge that is sized to retain a proximal region 130 of the spout 103 when the spout 103 is folded down upon itself within the cavity 150, as shown in FIGS. 2 and 3.

Referring to FIG. 4, the outer wall 112 of the lid 102 typically has an external diameter of about 6 cm to about 8 cm. The cavity 150 defined by the inner wall 113 typically has a maximum width (e.g., along a top surface of the lid 102) of about 4.5 cm to about 8.0 cm and a minimum internal width of about 3.5 cm to about 6.0 cm. A diameter of the opening 117 varies (e.g., along the upper and lower ridges 118, 119) in a range of about 1 cm to about 3 cm. The small opening 120 in the lower ridge 119 typically has a diameter of about 0.75 mm to about 1.25 mm (e.g., about 1.00 mm). A thickness of the protrusion 116 typically varies between about 1.2 cm (e.g., along the inner wall 113) and about 2.0 cm. The protrusion 116 typically has a length (e.g., extending from the inner wall 133 inward, toward the central axis 121) of about 2 mm to about 6 mm, which is sufficient to retain the proximal region 130 of the spout 103 in a folded configuration. The lid 102 is a rigid component that is typically made of one or more materials, such as a TPE, urethane, polypropylene, polyamide, or copolyester. The sheath 105 is typically made of one more materials that include silicone, urethane, or a similar TPE. The lid 102 and the sheath 105 are typically manufactured via injection molding or compression molding, depending on their material formulations.

Referring to FIGS. 1-8, the spout 103 is a flexible, reversibly deformable fluid delivery component that can be opened by suctioning to withdraw fluid from the container 101. The spout 103 can be bent from an extended configuration 132 (shown in FIGS. 1 and 4-8) in which a mouthpiece 123 of the spout 103 is relaxed along its full length for insertion into the mouth to the compressed configuration 134 (shown in FIGS. 2 and 3) in which the mouthpiece 123 is folded upon itself within the cavity 150 of the lid 102 and therefore not accessible for insertion into the mouth.

The spout 103 is a unitary component that defines a base 122 by which the spout 103 can be secured to the lid 102 within the opening 117 and the mouthpiece 123 (e.g., a mouthpiece), which extends from the base 122. The base 122 has a generally circular outer cross-sectional profile and includes an upper flange 124 (e.g., having a generally triangular cross-sectional shape), an intermediate flange 125, a lower flange 126, and an end piece 127. The lower flange 126 typically has a thickness in a range of about 0.5 mm to about 2.0 mm. Referring to FIG. 4, when the spout 103 is appropriately secured to the lid 102 via a compression fit within the opening 117, the spout 103 creates a fluid-tight seal with the lid 102 such that fluid within the container 101 is prevented from escaping between the spout 103 and the lid 102. For example, in such position, the upper ridge 118 of the lid 102 is disposed between the upper and intermediate flanges 124, 125 of the spout 103, such that the upper ridge 118 and the flanges 124, 125 together form the fluid-tight seal. In this manner, the upper ridge 118 provides a protruding circumferential edge that acts as a sealing element against the intermediate flanges 124, 125, which provide cooperating sealing elements.

Furthermore, the lower flange 126 of the spout 103 is seated against the lower ridge 119 of the lid 102 such that the lower flange 126 and the lower ridge 119 together form a pressure relief valve (e.g., an atmospheric vent) adjacent the small opening 120 in the lower ridge 119. For example, when the mouthpiece 123 of the spout 103 is not in use (e.g., free from a suction force), the lower flange 126 contacts the lower ridge 119 and therefore closes the small opening 120 in the lower ridge 119, such that a fluid-tight seal is formed between the lower ridge 119 and the lower flange 126. However, as fluid is suctioned out of the container 101 through the mouthpiece 123 (e.g., thereby reducing the pressure inside of the container 101), the lower flange 126 is forced downward (e.g., pulled inward) by negative pressure generated within the container 101 by the suction force. When a magnitude of the suction force becomes large enough (e.g., such that a difference between the pressure inside of the container 101 and the atmospheric pressure external to the container 101 is large enough) to separate the lower flange 126 from the lower ridge 119, air passes through the small opening 120 in the lower ridge 119 into the container 101, thereby increasing the pressure within the container 101 that has been reduced by suctioning. In this manner, the spout 103 acts as pressure relief valve that can modulate (e.g., equalize) the pressure within the container 101 without the child having to pause a suctioning action to equalize the pressure within the container 101. Once the internal and external pressures are equalized, the lower flange 126 reseals to the lower ridge 119.

Referring to FIG. 4, when the spout 103 is positioned within the opening 117 of the lid 102, the end piece 127 is spaced apart from the lid 102 and provides a grasping surface by which the end piece 127 can be squeezed and pulled downward from the lid 102 through the opening 117 to remove the spout 103 from the lid 102. The end piece 127 defines opposite, curved openings 128 about a circumference of the base 122 that contribute to a flexibility of the end piece 127 so that the end piece 127 can be easily grasped by a user.

Figure 6:
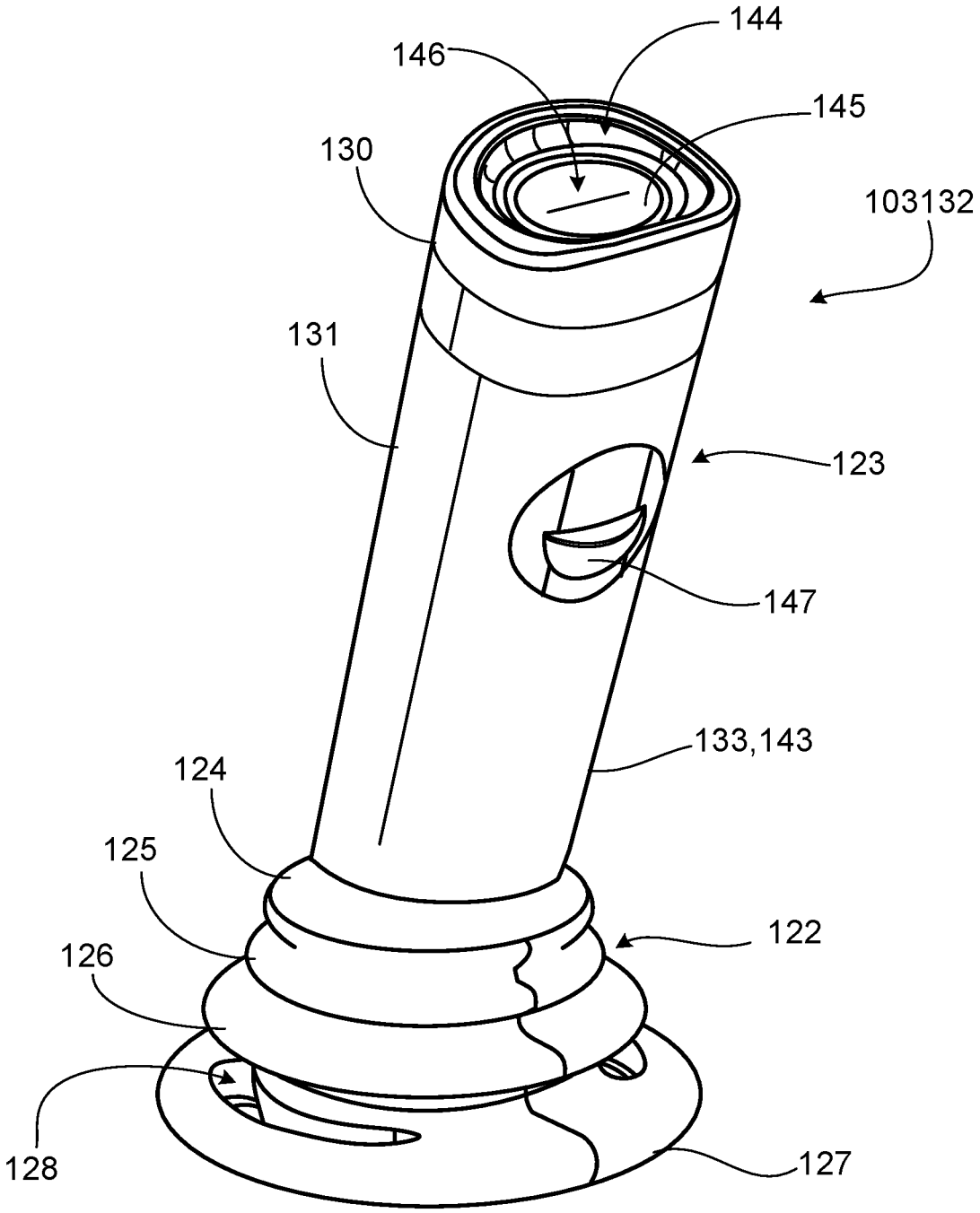
FIG. 6 is a perspective view of the spout of the fluid dispenser of FIG. 1 in the extended configuration.
Figure 7:
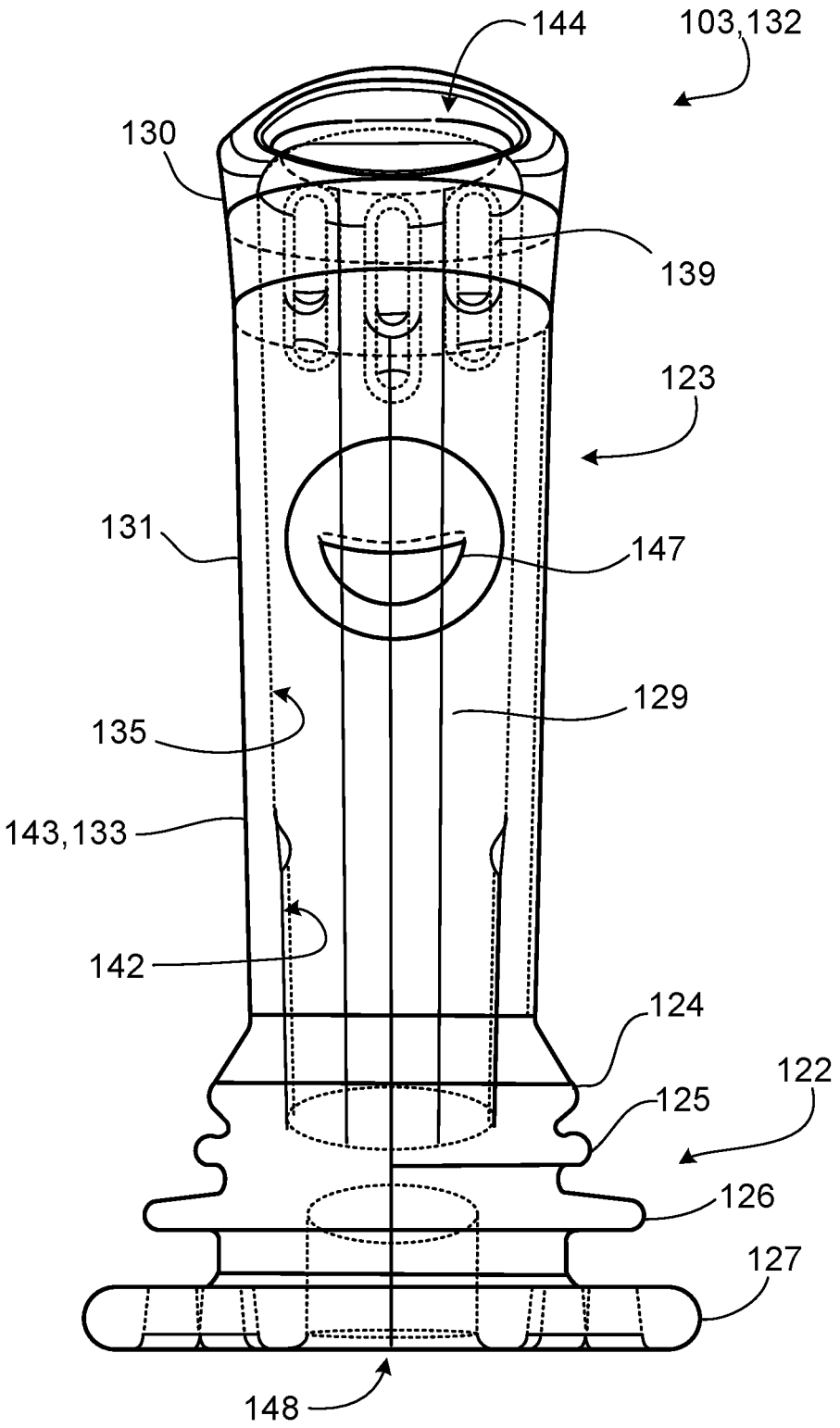
FIG. 7 is a rear view of the spout of the fluid dispenser of FIG. 1 in the extended configuration.

Referring to FIGS. 4, 6, and 7, a width and a depth of the mouthpiece 123 increase from minimum values at the base 122 to maximum values at the proximal region 130 of the mouthpiece 123. Accordingly, the larger, proximal region 130 of the mouthpiece 123 can comfortably fit within the mouth of a child, which is wider than an area formed by the lips of the mouth when the lips are pursed about the smaller, central region 131 of the mouthpiece 123. Referring to FIG. 7, the mouthpiece 123 typically has a minimum width of about 1 cm to about 2 cm and a maximum width of about 1.5 cm to about 2.5 cm. Referring to FIG. 4, the mouthpiece 123 typically has a minimum depth of about 0.5 cm to about 1.5 cm and a maximum depth of about 0.6 cm to about 2.0 cm. The mouthpiece 123 typically has a length of about 2.5 cm to about 10.0 cm.

Referring to FIGS. 4 and 7, an inner surface 135 of the spout 103 defines a fluid channel 129 along the base 122 and the mouthpiece 123 through which contents can flow out of the container 101 upon application of a suction force to the mouthpiece 123. Referring particularly to FIG. 7, a width of the fluid channel 129 varies along an axis 141 of the fluid channel 129 from a minimum value at an opening 148 of the base 122 to a maximum value at a recessed cavity 144 of the mouthpiece 123. When a suction force is applied to the mouthpiece 123, a pressure of fluid flowing into the opening 148 from the container 101 increases due to a small width of the opening 148 relative to the inner diameter of the container 101. However, as the fluid continues to flow out of the base 122 and through the mouthpiece 123, the pressure of the fluid in the mouthpiece 123 gradually decreases as the width of the fluid channel 129 gradually increases towards the recessed cavity 144. Accordingly, the change in inner diameter of the fluid channel 129 modulates the pressure within the fluid as the fluid is ultimately expelled from the mouthpiece 123. Referring to FIG. 7, the fluid channel 129 typically has a minimum width of about 4 mm to about 10 mm and a maximum width of about 5 mm to about 12 mm.

Figure 8:
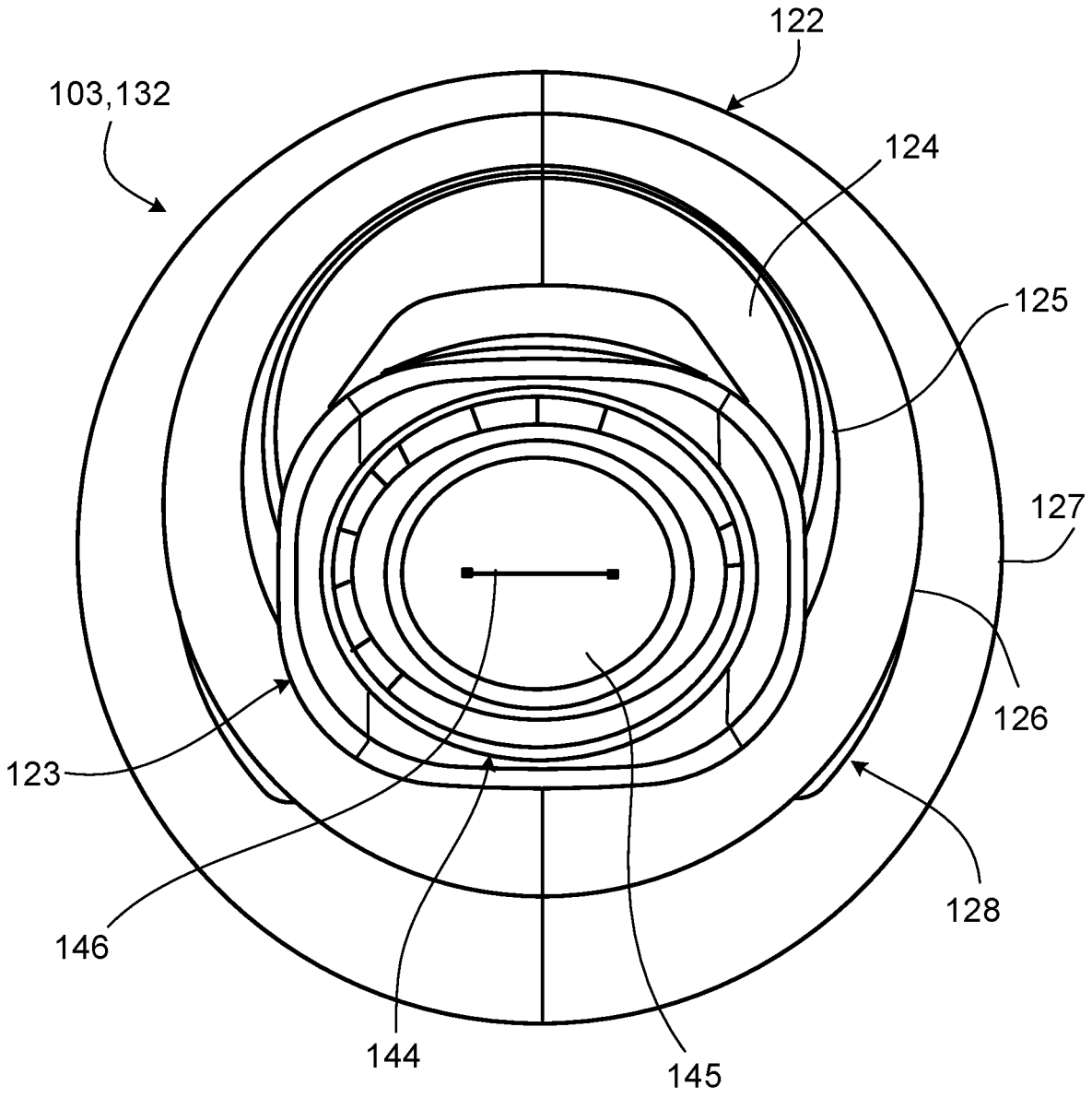
FIG. 8 is a top view of the spout of the fluid dispenser of FIG. 1 in the extended configuration and including a slit disposed in a horizontal orientation with respect to a mouthpiece width of the spout.

Referring to FIGS. 4 and 8, cross-sectional shapes of an outer surface 133 of the mouthpiece and of the inner surface 135 are generally round-rectangular (e.g., rectangular with rounded corners), such that the inner surface 135 defines two, opposite curved surface areas. The shape of the inner surface 135 transitions along the base 122 in a manner such that the opening 148 is circular or otherwise round. Referring to FIG. 7, the mouthpiece 123 defines three ribs 139 disposed along each side of the fluid channel 129 (e.g., arranged along each curved surface area). An arrangement of the ribs 139 along the inner surface 135 generally follows a curvature of the roof of the mouth such that the mouthpiece 123 can be comfortably disposed in the child's mouth. Furthermore, the ribs 139 maintain a structural integrity of the spout 103, while still allowing the spout 103 to be flexibly deformed (e.g., compressed) by the lips or teeth during suctioning. The ribs 139 typically have a length of about 6 mm to about 20 mm and, within a set, are typically spaced apart from each other by about 5° to about 20° along the inner surface 135 of the mouthpiece 123.

The spout 103 also defines two opposite ribs 142 that extend from the base 122 to the mouthpiece 123 along the fluid channel 129. The ribs 142 maintain a structural integrity of a distal region 143 of the mouthpiece 123, while still allowing the spout 103 to be flexibly folded upon itself in the compressed configuration 134 (as shown in FIGS. 2 and 3). The ribs 142 also define locations at which the spout 123 can be folded into the compressed configuration 134. For example, the spout 123 is structurally weaker just above the ribs 142 and can therefore be bent more easily by a user at apexes of the ribs 142. The ribs 142 typically have a length of about 10 mm to about 40 mm and are typically spaced apart from each other by about 180°.

Referring particularly to FIG. 4, location of the ribs 139 along the proximal region 130 stabilizes the structure of the spout 103 (e.g., reinforces a wall of the spout 103) while the spout 103 is compressed by a child's lips or teeth. Lower beveled edges 140 of the ribs 139 provide a transition location between the central region 131 and the proximal region 130 and further serve to guide fluid flow out of the spout 103 during suctioning. Additionally, the wall of the mouthpiece 123 is relatively thin along the central and distal regions 131, 143 and is relatively thick along the proximal region 130. Along the proximal region 130, a thickness of the wall (e.g., excluding the ribs 139) is typically about 1 mm to about 2 mm, and a maximum thickness of the ribs 139 is typically about 1.5 mm to about 3.0 mm. Along the central and distal regions 131, 143, a thickness of the wall (e.g., excluding the ribs 142) is typically about 1 mm to about 2 mm, and a maximum thickness of the ribs 142 is typically about 1.5 mm to about 3.5 mm.

Referring to FIGS. 4 and 8, an end of the mouthpiece 123 is formed as a recessed cavity 144. A bottom wall 145 of the recessed cavity 144 closes the fluid channel 129, which itself has a cross-sectional shape that is generally round-rectangular, as discussed above with respect to the inner surface 135 of the spout 103. The bottom wall 145 has a generally oval cross-sectional shape from the perspective shown in FIG. 8 and has a generally dome-shaped cross-sectional profile from the perspective shown in FIG. 4. A slit 146 is disposed along a centerline of the bottom wall 145 and typically has a length of about 2.5 mm to about 5.0 mm. The slit 146 is oriented horizontally (e.g., parallel to a width of the mouthpiece 123, as shown in FIG. 8). Fluid can be withdrawn from the container 101 through the slit 146 when a suction force is applied to the mouthpiece 123, and a small amount of withdrawn fluid can pool in the recessed cavity 144. Owing to the dome shape of the bottom wall 145 (as shown in FIG. 4), when the proximal region 130 of the mouthpiece is compressed, the bottom wall 145 bows outward to open the mouthpiece 123 along the slit 146 to allow fluid to flow through the slit 146. Such configuration advantageously allows the mouthpiece 123 to open to a wider extent than can other conventional mouthpieces with flat end surfaces that do not bow outward to such an extent when compressed. For example, when the proximal region 130 of the mouthpiece 123 is compressed, the slit 146 can open to an extent of about 0.1 mm to about 4.0 mm.

The mouthpiece 123 is oriented at an angle of about 45° to about 80° with respect to the lid 102 (e.g., defined between the axis 141 of the fluid channel 129 and the central axis 121 of the lid). Such angle allows the fluid dispenser 100 to be held in an upright position while placing the spout 103 within the mouth without having to bend the head sufficiently forward to place the spout 103 in the mouth. The spout 103 further defines an extension piece 147 along the mouthpiece 123. The extension piece 147 can be pulled to release the spout 103 from the compressed configuration 134 (shown in FIGS. 2 and 3). In some embodiments, the extension piece 147 is formed as an aesthetic feature (e.g., a design logo).

The spout 103 is a flexible component that is typically made of one or more elastomeric materials, such silicone or a TPE. The spout 103 is typically manufactured via compression molding or injection molding. Accordingly, the spout 103 typically has a hardness in a range of 35 Shore A to 60 Shore A.

Referring again to FIG. 3, the straw 104 is a rigid component that can be secured within the base 122 of the spout 103 via compression fit. The straw 104 extends downward to the circumferential fluid channel 149 of the container 101 such that the straw 104 can access fluid collected therein. The straw 104 typically has a length of about 5 cm to about 9 cm and an outer diameter of about 4 mm to about 10 mm (e.g., about 8 mm). The straw 104 is typically made of one or more materials, such as urethane or polypropylene and is typically manufactured via an extrusion process or a molding process.

In some embodiments, as shown in FIG. 2, the fluid dispenser 100 further includes a cap 151 that is sized to cover the lid 102 when the spout 103 is bent into the compressed configuration 134 within the cavity 150 of the lid 102. The cap 151 can be easily placed onto and removed from the lid 102 and can prevent dirt, dust, and other debris from contacting the spout 103 when disposed on the lid 102. The cap 151 is a flexible component that is typically made of one or more malleable materials, such as silicone, other urethanes, or TPEs. The cap 151 can be stored on a bottom surface region of the body 107 of the container 101 while the drinking dispenser 100 is used for drinking.

In use, the fluid dispenser 100 can be disassembled into its component parts (e.g., the container 101, the lid 102, the spout 103, the straw 104, the sheath 105, and the cap 151) for easy washing of the components parts. The component parts can be easily reassembled for use. For example, to assemble the fluid dispenser 100, the straw 104 is inserted within the base 122 of the spout 103, and the mouthpiece 123 of the spout 103 (e.g., with the straw 104 attached to the spout 103) is inserted through the opening 117 of the lid 102. For example, the mouthpiece 123 is inserted from beneath the opening 117 and pulled upward through the opening 117 until the base 122 of the spout 103 is positioned within the opening 117 (e.g., compressed to the inner wall 113 of the lid 102) to form a fluid-tight seal between the spout 103 and the lid 102. Fluid is poured into the container 101. The sheath 105 can be optionally placed upon the shoulder 109 of the container 101, and the lid 102, with the spout 103 secured thereto, is screwed onto the container 101.

The mouthpiece 123 of the spout 103 is inserted into the mouth, and suction is applied to the mouthpiece 123, thereby causing fluid to flow into the straw 104 through the spout 103 on demand. As suction is applied, the fluid forces the slit 146 open and exits the spout 103 into the mouth. Furthermore, upon the suction force reaching a threshold magnitude, the lower flange 126 of the base 122 of the spout 103 separates (e.g., moves downward) from the lower ridge 119 of the lid 102 to allow ambient air to flow through the small opening 120 in the lid 102 into the container 101 to increase (e.g., equalize) the pressure within container 101, even while the fluid-tight seal is maintained between the upper ridge 118 and the upper and intermediate flanges 124, 125 to prevent spillage of fluid through the opening 117 of the lid 102. While suction is applied to the mouthpiece 123, the lower flange 126 of the base 122 will remain separated from the lower ridge 119 of the lid 102 until the pressure in the container 101 is substantially equal to the ambient air pressure. Once the pressure within the container 101 has equalized with the ambient air pressure, the lower flange 126 will rebound toward the lid 102 to close the small opening 120 in the lid 102.

The suction force can be removed from the mouthpiece 123 to cease the flow of fluid out of the fluid dispenser 100. When the fluid dispenser 100 is not in use, the spout 103 can optionally be bent from the extended configuration 132 (shown in FIG. 1) to the compressed configuration 134 (shown in FIGS. 2 and 3) and covered with the cap 151.

Other embodiments are possible.

For example, while the fluid dispenser 100 has been described as a baby bottle or a sippy cup, in some embodiments, a fluid dispenser that is otherwise substantially similar in construction and function to the fluid dispenser 100 may be configured (e.g., according to various component dimensions) to serve as a general-purpose water bottle or a sports bottle that is suitable for individuals of any age. For such embodiments, a body of the container typically has a length of about 12 cm to about 20 cm and an outer diameter of about 6 cm to about 10 cm. An interior region of the body can typically hold a fluid volume of about 300 mL to about 1,000 mL.

Figure 9:
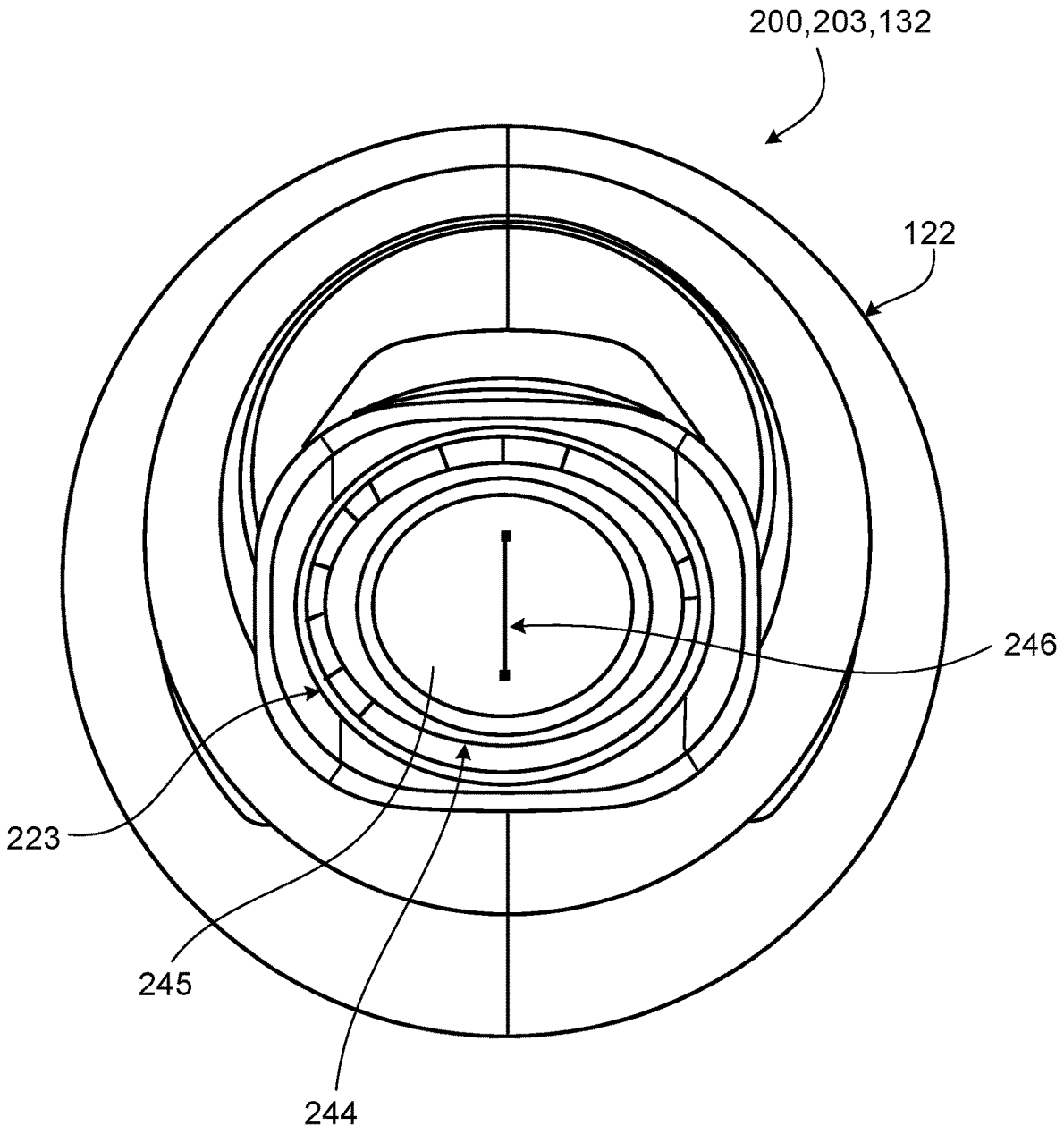
FIG. 9 is a top view of a spout of a fluid dispenser in an extended configuration and including a slit disposed in a vertical orientation with respect to a mouthpiece width of the spout.

While the fluid dispenser 100 has been described and illustrated as including the slit 146 in a horizontal orientation (e.g., parallel to a width of the mouthpiece 123, as shown in FIG. 8), in some embodiments, a fluid dispenser that is otherwise substantially similar in construction and function to the fluid dispenser 100 may be include a slit that is disposed in a vertical orientation (e.g., perpendicular to a width of a mouthpiece and parallel to a depth of the mouthpiece). For example, FIG. 9 illustrates a spout 203 of a fluid dispenser 200 that includes a slit 246 in a vertical orientation. The spout 203 is substantially similar in construction and function to the spout 103, except that the slit 246 is oriented vertically instead of horizontally. Accordingly, the spout 203 includes a base 222 and a mouthpiece 223 that are respectively identical to the base 122 and the mouthpiece 123, with the exception of a slit orientation. The vertical orientation of the slit 246 will permit the slit 246 to open even further than that of the slit 146 when a proximal region of the mouthpiece 223 is compressed, such as to an extent of about 1 mm to about 4 mm, depending on the amount of compression. The slit 246 typically has a length of about 3 mm to about 5 mm and is centered along a bottom wall 245 of a recessed cavity 244 of mouthpiece 223.

While the center of the opening 117 of the lid 102 has been described and illustrated as spaced apart from the central axis 121 of the lid 102, in some embodiments, a fluid dispenser that is otherwise substantially similar in construction and function to the fluid dispenser 100 includes a lid with an opening that is centered on a central axis of the lid, such that the lid (e.g., including upper and lower ridges) has a symmetric profile (e.g., excluding a protrusion, such as the protrusion 116) about the central axis of the lid.

Figure 10:
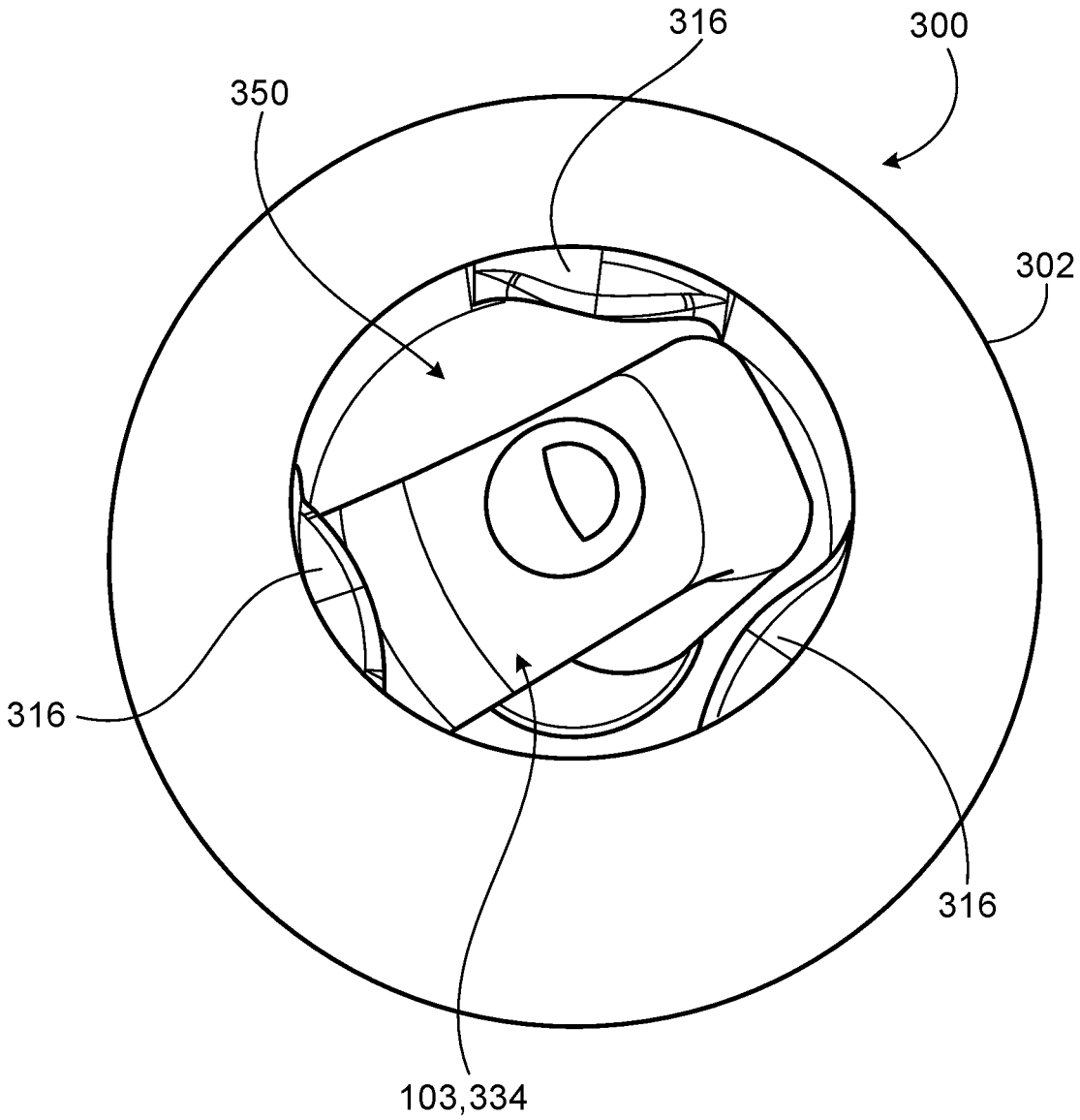
FIG. 10 is a top perspective view of a spout assembled with a lid that includes multiple protrusions for retaining the spout in a compressed configuration.

While the fluid dispenser 100 has been described and illustrated as including a single protrusion 116 for retaining the spout 103 in the compressed configuration 134, in some embodiments, a fluid dispenser that is otherwise substantially similar in construction and function to the fluid dispenser 100 includes multiple (e.g., three to five) protrusions spaced about a cavity of the lid such that a straw of the fluid dispenser can be retained in a compressed configuration in multiple locations about a circumference of the cavity. For example, FIG. 10 illustrates a portion of a fluid dispenser 300, which includes a lid 302 and the spout 103. The fluid dispenser 300 is substantially similar in construction and function to the fluid dispenser 100, except that the lid 302 includes multiple protrusions 316, instead of the single protrusion 116 included in the lid 102. Accordingly, the fluid dispenser 300 further includes the container 101 and optionally includes the straw 104, the sheath 105, and the cap 151. The mouthpiece 123 of the spout 103 can be bent from an extended configuration and retained in a compressed configuration 334 at each of the protrusions 316. The protrusions 316 may be equally or unequally spaced apart from each other about a cavity 350 of lid 302 in a range of about 100° to about 120°, as shown in FIG. 10.

In some embodiments, a fluid dispenser that is otherwise substantially similar in construction and function to any of the fluid dispensers described above does not include one or more of the straw 104, the sheath 105, and the cap 151. In embodiments that exclude the straw 104, a child can simply tilt the fluid dispenser towards his or her mouth (e.g., as a sports bottle is handled) to drink from the fluid dispenser.

While the fluid dispenser 100 has been described and illustrated as including the cap 151 as a component that is unattached to other components of the fluid dispenser 100, in some embodiments, a fluid dispenser that is otherwise substantially similar in construction and function to any of the above-mentioned fluid dispensers includes a cap that is tethered to a container or to a sheath of the fluid dispenser.

Furthermore, while the above-mentioned fluid dispensers has been described with respect to certain dimensions, shapes, and material formulations, in other embodiments, a fluid dispenser that is substantially similar in construction and function to any of the above-mentioned fluid dispensers may include one or more similar features that have one or more dimensions, shapes, and/or material formulations that are different from those described with respect to the above-mentioned fluid dispensers. Other embodiments are also within the scope of the following claims.

What is claimed is:

1. A fluid dispenser, comprising:

a lid defining a central axis and comprising a first protruding edge and a second protruding edge, the second protruding edge defining a first opening that passes through the second protruding edge and that is spaced radially from the central axis of the lid; and a flexible fluid delivery component defining an interior fluid channel, the interior fluid channel terminating at a second opening that is positioned along the central axis of the lid, and the flexible fluid delivery component comprising:

a first flange disposed adjacent to an upper surface of the first protruding edge of the lid, a second flange disposed adjacent to a lower surface of the first protruding edge of the lid, the first and second flanges of the flexible fluid delivery component and the first protruding edge of the lid together forming a fluid-tight seal between the flexible fluid delivery component and the lid, and a third flange disposed adjacent to the second protruding edge of the lid such that the third flange and the second protruding edge together form a pressure relief valve that regulates an airflow through the first opening in the second protruding edge of the lid, wherein the pressure relief valve is adjustable between:

a first configuration in which the third flange of the flexible fluid delivery component contacts the second protruding edge of the lid to close the first opening to prevent air from flowing through the first opening, and a second configuration in which the third flange of the flexible fluid delivery component is separated from the second protruding edge of the lid to permit air to flow through the first opening.

2. The fluid dispenser of claim 1, wherein the lid is a rigid component that is configured to be secured to a container.

3. The fluid dispenser of claim 1, wherein the lid is configured to support the flexible fluid delivery component.

4. The fluid dispenser of claim 1, wherein the first protruding edge comprises a first sealing element.

5. The fluid dispenser of claim 4, wherein the first and second flanges respectively comprise second and third sealing elements that are configured to form a compression fit with the first protruding edge.

6. The fluid dispenser of claim 4, wherein the lid further defines a third opening that is sized to allow passage of the flexible fluid delivery component.

7. The fluid dispenser of claim 1, wherein the third flange of the flexible fluid delivery component is configured to be forced away from the lid to provide the second configuration of the pressure relief valve while the first protruding edge of the lid is engaged with the first and second flanges of the flexible fluid delivery component to form the fluid-tight seal.

8. The fluid dispenser of claim 1, wherein the third flange of the flexible fluid delivery component is configured to deform in response to a change in a pressure of fluid that is in contact with the flexible fluid delivery component.

9. The fluid dispenser of claim 1, wherein the flexible fluid delivery component is foldable upon itself to a compressed configuration.

10. The fluid dispenser of claim 9, wherein the lid defines one or more protrusions along an inner surface of the lid that are configured to retain the flexible fluid delivery component within a cavity of the lid in the compressed configuration.

11. The fluid dispenser of claim 1, wherein the flexible fluid delivery component comprises an elongate mouthpiece that defines a portion of the interior fluid channel.

12. The fluid dispenser of claim 11, wherein the elongate mouthpiece comprises a curved end surface that closes the interior fluid channel.

13. The fluid dispenser of claim 12, wherein the curved end surface defines a slit through which fluid can flow out of the interior fluid channel of the flexible fluid delivery component.

14. The fluid dispenser of claim 1, wherein the flexible fluid delivery component comprises a plurality of elongate support elements disposed about the interior fluid channel.

15. The fluid dispenser of claim 1, further comprising a container to which the lid can be secured for containing a fluid within the container.

16. The fluid dispenser of claim 15, wherein the lid and the container comprise threaded portions by which the lid and the container can be secured to each other.

17. The fluid dispenser of claim 15, wherein the flexible fluid dispenser is configured to dispense a liquid or a slurry.

18. The fluid container of claim 1, further comprising a straw sized to fit within the flexible fluid delivery component.

* * * * *